US006746282B2

(12) United States Patent
Meister

(10) Patent No.: US 6,746,282 B2
(45) Date of Patent: Jun. 8, 2004

(54) PRINTED CIRCUIT BOARD MOUNTABLE ELECTRICAL CONNECTOR

(75) Inventor: Douglas L. Meister, Loganville, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 10/171,043

(22) Filed: Jun. 13, 2002

(65) Prior Publication Data

US 2003/0232541 A1 Dec. 18, 2003

(51) Int. Cl.[7] ..... H01R 25/00
(52) U.S. Cl. ..... 439/638; 439/607; 439/608
(58) Field of Search ..... 439/638, 607, 439/608, 609, 526, 606, 650, 651, 652, 874, 876, 567, 569, 570

(56) References Cited

U.S. PATENT DOCUMENTS 5,409,386 A * 4/1995 Banakis et al. ..... 439/83
6,398,587 B1 * 6/2002 Chen et al. ..... 439/607
6,485,328 B1 * 11/2002 Wu ..... 439/567
6,599,136 B2 * 7/2003 Sheldon et al. ..... 439/92
6,609,929 B2 * 8/2003 Kamarauskas et al. .. 439/541.5
6,638,105 B1 * 10/2003 Wu ..... 439/567

* cited by examiner

*Primary Examiner*—P. Austin Bradley
*Assistant Examiner*—Edwin A. Leon

(57) ABSTRACT

An electrical connector including a shield with a front end, a back end, and at least one mounting member located on the back end, the at least one mounting member being arranged and configured for attaching the shield to a printed circuit board.

18 Claims, 7 Drawing Sheets

PRINTED CIRCUIT BOARD MOUNTABLE ELECTRICAL CONNECTOR

The present invention relates to electrical connectors, and more particularly to electrical connectors for use with printed circuit boards.

BACKGROUND OF THE INVENTION

In general, the use of electrical connectors to connect peripheral devices to a host system is well known. For example, plug and socket arrangements are frequently used with personal computers to allow keyboards, mouse, printers, etc., to be connected to and disconnected from the central processing unit both quickly and easily. These plug and socket arrangements are configured such that the socket is housed within the host system, and the plug is disposed at the end of a cord that ultimately terminates within the peripheral device. This arrangement works well for peripheral devices that require some amount of mobility during use, such as the keyboard of a personal computer.

However, this arrangement does not work as well for non-mobile peripherals. For example, where a peripheral device is not required to be moved during use, mounting the device directly to the host system conserves space and lessens the possibility the device will be inadvertently disconnected from the host system. An example of a non-mobile peripheral device is a module that includes a jack configured to receive a standard telephone line, thereby providing a host system access to a telephone network. As previously noted, present peripheral devices require the use of a cord to attach the plug to a printed circuit board within the peripheral device. As will be discussed in greater detail infra, the use of a cord in a peripheral device designed to be mounted directly to a host system limits the minimum size of the peripheral device, increases both the time and the cost of manufacture, and contributes to the difficulty experienced by anyone attempting to attach the peripheral device to the host system.

From the foregoing, it can be appreciated that it would be desirable to have a better approach for mounting non-mobile peripherals to a host system.

BRIEF DESCRIPTION OF THE DRAWINGS

The preferred embodiments of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 3 is a top, exploded, rear perspective view of an example of an electrical connector, in accordance with one embodiment of the invention.

Figure 1:
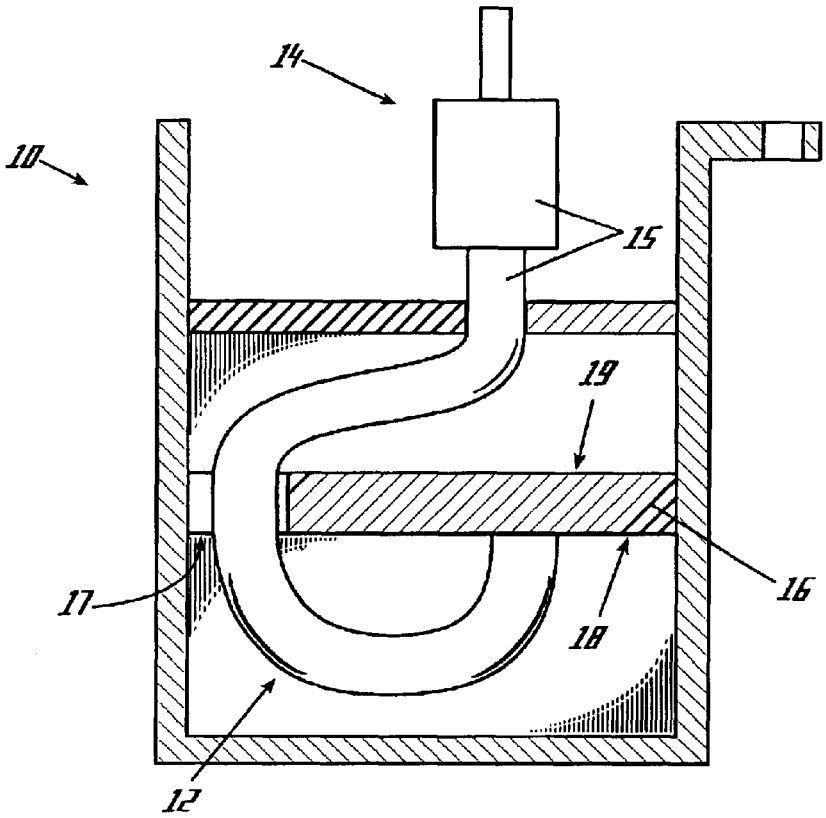
(Prior Art) Fig. 1
FIG. 1 is a cross-sectional view of an existing peripheral device including an electrical plug.

Reference will now be made in detail to the description of the electrical connectors for use with printed circuit boards as illustrated in the drawings. While the electrical connectors for use with printed circuit boards will be described in connection with these drawings, there is no intent to limit them to the embodiment or embodiments disclosed therein. On the contrary, the intent is to cover all alternatives, modifications and equivalents included within the spirit and scope of the electrical connectors for use with printed circuit boards as defined by the appended claims.

DETAILED DESCRIPTION OF THE PREFERRED EMBODIMENTS

The preferred embodiments of the present invention are described in the context of electrical connectors. More specifically, stationary peripherals are connected to a host through shielded connectors providing rigidity for ease of assembly. The following describes one prior structure and then describes structural aspects of various preferred embodiments of the present invention.

Referring now in more detail to the drawings, FIG. 1 shows a cross-section of an existing peripheral device 10 configured to be mounted directly to a host system. As previously noted, present peripheral devices 10 require the use of a cord 12 to attach a plug 14 to a printed circuit board 16 within the peripheral device 10. Typically, as shown, the end of the cord 12 within the peripheral device 10 is attached to the backside 18 of the printed circuit board 16 and then passed through a small gap 17 formed in the printed circuit board 16. This helps lessen the stress applied to the solder connection between the cord 12 and the printed circuit board 16. As such, this configuration lessens the possibility that the connection will be degraded and that the cord 12 will be inadvertently separated from the printed circuit board 16. However, this configuration often means that the overall size of the peripheral device 10 is dictated, at least in part, by the bend radius of the cord 12. The cord 12 may also be attached to the topside 19 of the printed circuit board 16. However, this configuration does not provide the strain relief to the solder connection between the cord 12 and the printed circuit board 16 noted above.

As well, because the plug 14 is not rigidly secured to the peripheral device 10, existing configurations hamper connecting the plug 14 to a corresponding socket. Therefore, an operator is unable to blind-mate the plug 14 to the corresponding socket (not shown). Rather, the operator must first insert the plug 14 into the socket prior to securing the peripheral device 10 to the host system. This operation is hampered by the length of the cord 12, which is typically minimized, therefore requiring that the peripheral device 10 be held in close proximity to the host system (not shown). Of course, the cord 12 can be lengthened, however, this would typically require the size of the peripheral device 10 to be increased to store any excess cord 12 once the peripheral device 10 is secured to the host system.

The use of a cord 12 necessitates that the cord 12 be hand soldered to the printed circuit board 16 rather than wave soldered, whether the cord 12 is mounted to the backside 18 or the topside 19. When the cord 12 is mounted to the backside 18 (FIG. 1), the necessity of hand soldering is due in part to the fact that a portion of the cord 12 extends below the backside 18 of the printed circuit board 16 and would therefore contact the molten solder pool during the wave solder process. In the wave soldering process, a printed circuit board 16 is conveyed over a molten pool of solder. Portions of the printed circuit board not to be soldered can be masked. Those other portions of the printed circuit board 16 that extend into the molten solder pool, such as electrical leads from components, are soldered in place. Even if the cord 12 can be kept out of the molten solder pool, such as when the cord 12 is mounted to the topside 19, overmolding 15 present on both the cord 12 and the plug 14 are readily damaged by the excessive temperatures encountered during the wave soldering process.

Figure 2A:
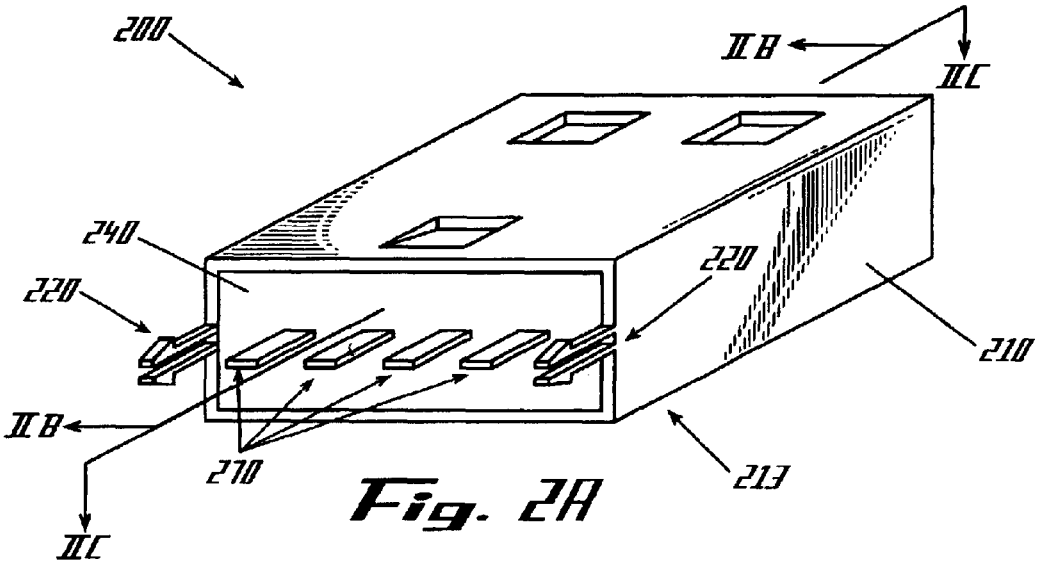
FIG. 2A is a top, rear perspective view of an example of an electrical connector, in accordance with one embodiment of the invention.
Figure 5:
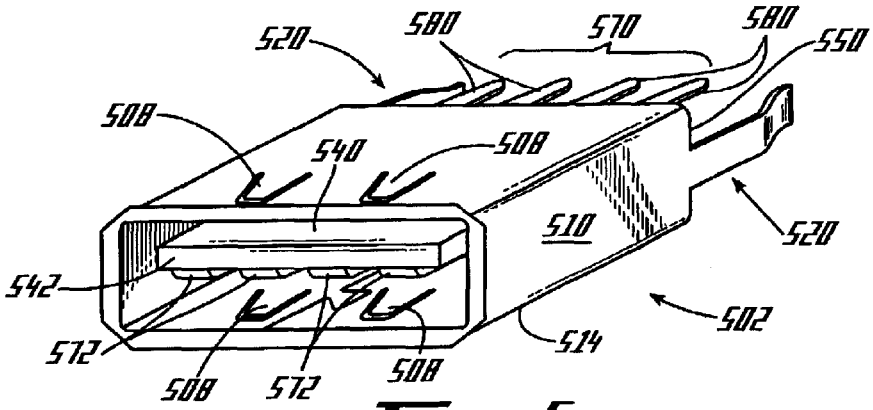
FIG. 5 is a top, front perspective view of an example electrical connector, in accordance with one embodiment of the invention.
Figure 6A:
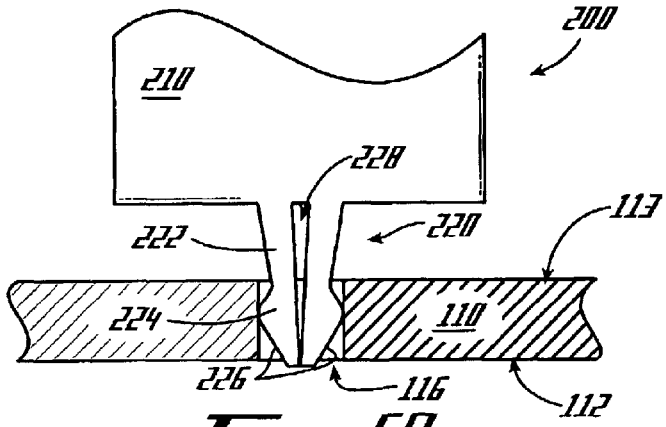
FIGS. 6A–6B are cross-sectional views of the example electrical connector shown in FIG. 1 being inserted into a printed circuit board, in accordance with one embodiment of the invention.
Figure 6B:
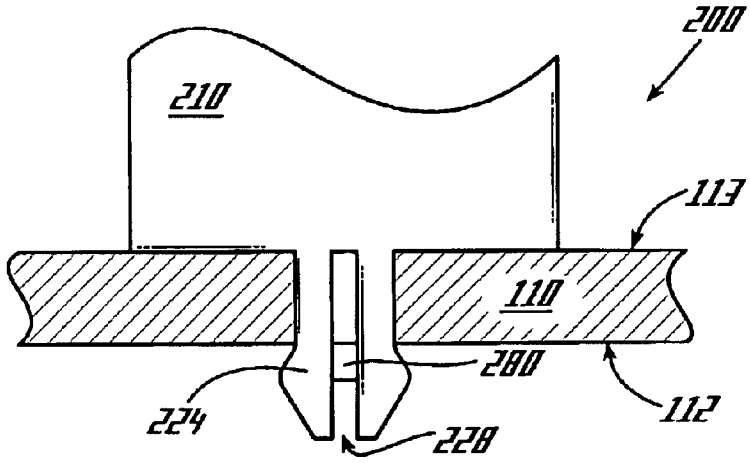

FIG. 2A illustrates a top, rear perspective view of one example of a connector plug 200, constructed in accordance with one preferred embodiment of the present invention. The plug 200 is arranged and configured to form a mechanical and electrical connection with a socket, such as that example shown as socket 502 (FIG. 5). As shown, the plug 200 includes a connector shield 210, a conductor carrier 240 and a plurality of conductors 270. The conductor carrier 240 both physically supports and insulates the conductors 270. The conductor carrier 240 with its associated conductors 270 are then slidably received within the connector shield 210. Once the conductor carrier 240 is secured within the connector shield 210, the plug 200 is ready for attachment to a printed circuit board 110 (FIGS. 6A–6B).

Figure 2B:
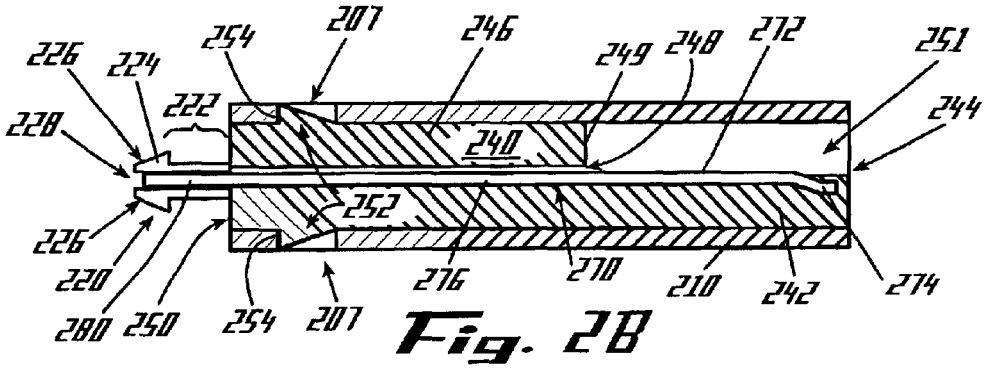
FIG. 2B is a cross-sectional view along line IIB—IIB of the example electrical connector shown in FIG. 2A.
Figure 2C:
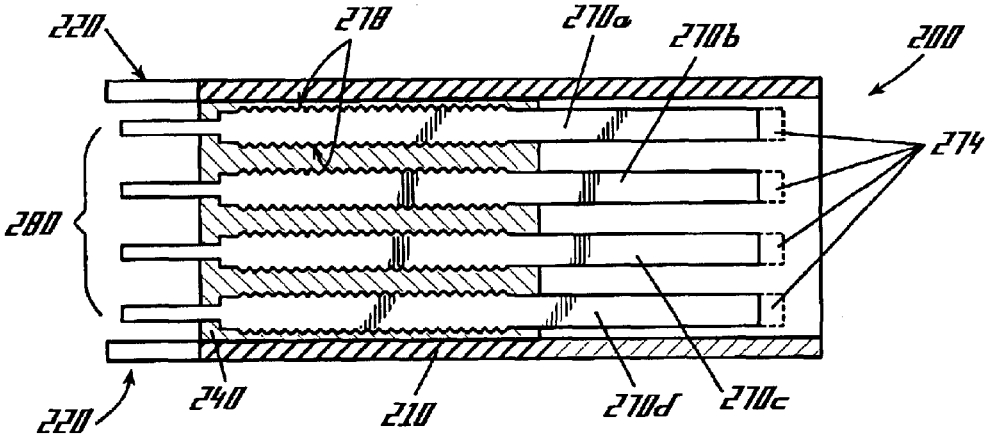
FIG. 2C is a cross-sectional view along line IIC—IIC of the example electrical connector shown in FIG. 2A.

FIG. 2B shows the arrangement with which the conductor carrier 240 supports each of the conductors 270. The conductor carrier 240 includes a contact bed 242, a body portion 246, a front wall 249, a rear surface 250 and a retention tab 252. The contact bed 242 physically supports the contact portion 272, thereby enhancing proper electrical contact after the plug 200 is inserted into a corresponding socket 502 (FIG. 5). The contact bed 242, front wall 249 and shield 210 also form a cavity 251 for receiving a portion of a corresponding connector, as is discussed in great detail hereinafter. In some embodiments, the tip 274 of the conductor 270 bends slightly downward so that the tip 274 is embedded in the nose 244 of the conductor carrier 240. This construction prevents the conductor 270 from being damaged during the insertion process and helps secure the conductor 270 within the conductor carrier 240. A straight tip could be susceptible to getting caught and bent backward. Channels 248 formed in the body portion 246 of the conductor carrier 240 serve to secure the conductors 270 in place. Numerous configurations of the central portion 276 of the conductor 270 are contemplated to greater secure the conductors 270 in the channels 248 of the conductor carrier 240, such as serration, friction, embedding, etc. As shown, opposing sides 278 (FIG. 2C) of conductors 270*a–d* are serrated to help prevent slippage. Again, serration is optional, each of the sides 278 of each of the conductors 270 may be smooth for their entire lengths.

Continuing with FIG. 2B, extending beyond the rear surface 250 of the conductor carrier 240, solder tails 280 are arranged and configured for insertion into a printed circuit board 110 (FIG. 6A), thereby allowing electrical connections to be made. Mount members 220 located on the back end 213 of the shield 210 and extending at least substantially parallel to the solder tails 280, preferably, are used to mechanically attach the plug 200 to the printed circuit board 110. As shown, the mount members 220 include a stem portion 222, an enlarged head 224, and a longitudinal gap 228. The length of the stem portion 222 is substantially equal to the width of the printed circuit board 110. This enables the enlarged head 224 to engage the backside 112 of the printed circuit board 110 when the plug 200 is mounted on the topside 113. Sloped forward edges 226 of the enlarged head 224 cooperate with the longitudinal gap 228 to facilitate insertion of the mount members 220 into corresponding mounting holes 116 (FIGS. 6A–6B) in the printed circuit board 110.

As previously noted, the conductor carrier 240 is configured to be slidably inserted into the connector shield 210. To ensure the conductor carrier 240 remains firmly in place within the connector shield 210, retention tabs 252 are formed on the conductor carrier 240 that engage corresponding retention orifices 207 in the connector shield 210. The retention tabs 252 are sloped to facilitate insertion of the conductor carrier 240 into the connector shield 210. The trailing edge 254 of each retention tab 252 is substantially perpendicular to the corresponding surface of the conductor carrier 240, and thereby engages the retention orifices 207 and prevents slippage.

Figure 2D:
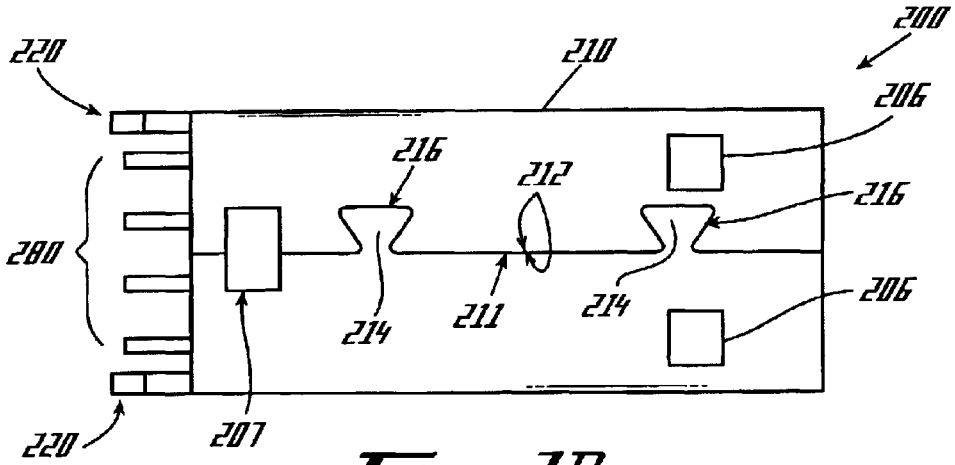
FIG. 2D is a bottom view of the example electrical connector shown in FIG. 2A.
Figure 7:
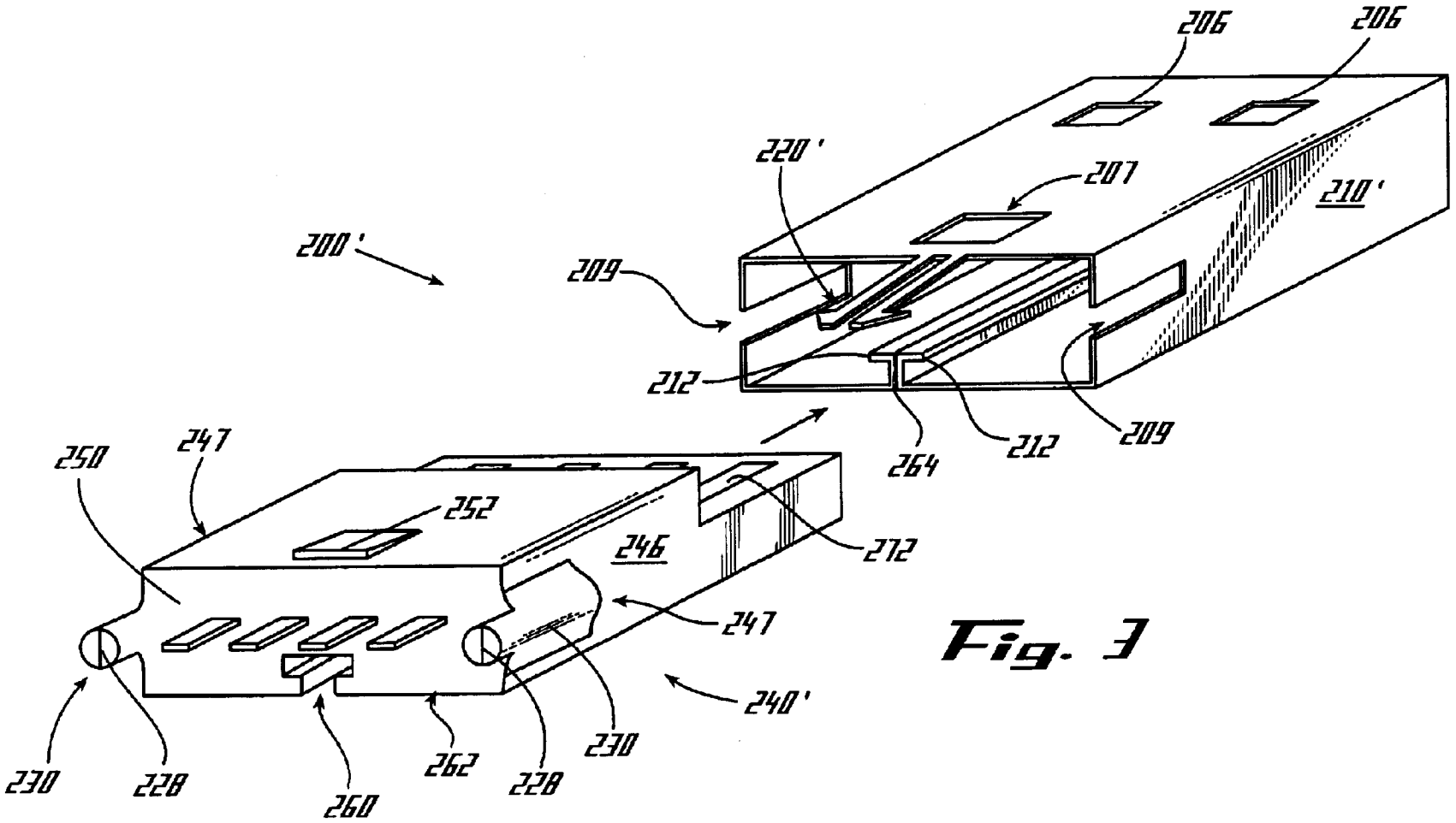
FIGS. 7A–7B are cross-sectional views of the example electrical connector shown in FIG. 5 being inserted into a printed circuit board, in accordance with one embodiment of the invention.

FIG. 2D is a bottom view of the plug 200. In a preferred embodiment, securing recesses 206 are formed in the connector shield 210. The securing recesses 206 cooperate with securing fingers 508 formed in the socket 502 (FIG. 5) to ensure the plug 200 remains firmly inserted in the socket 502, thereby insuring both a proper mechanical connection and a proper electrical connection. Preferably, the connector shield 210 is formed from sheet metal. Therefore, a seam 211 formed by the opposing edges 212 of the connector shield 210 is present. Any number of seam 211 configurations are adequate to insure the connector shield 210 remains intact over the life of the electrical connector. As shown, one edge includes interlocking tabs 214 while the opposite edge has matching interlocking recesses 216 formed therein. When forming the connector shield 210, the interlocking tabs 214 are positioned in the interlocking recesses 216. To further secure the seam 211, the seam 211 can be spot or tack welded.

Various other preferred embodiments of the present invention include mounting feet 230 (FIG. 3) for securing an electrical connector to a printed circuit board 110. As shown in FIG. 3, mounting feet 230 of a plug 200' are preferably formed integrally with conductor carrier 240' and extend longitudinally beyond the rear surface 250. Preferably, the mounting feet 230 are circular in cross-section, however, any number of cross-sectional shapes are acceptable. The mounting feet 230 preferably include a longitudinal gap 228 dividing the mounting feet 230 into two parts. This allows the two parts to be biased toward each other when each mounting foot 230 is inserted into a corresponding mounting hole 116 (FIG. 6A) in the printed circuit board 110. As shown, the mounting feet 230 are preferably each disposed and integrally formed on a side surface 247 of the conductor carrier 240'. However, in some embodiments, the mounting feet 230 can be located anywhere on the body portion 246 of the conductor carrier 240', to include the rear surface 250, provided there is enough room. However, when the mounting feet 230 are disposed as shown, recesses 209 are provided in the connector shield 210' that accommodate the mounting feet 230 during insertion of the conductor carrier 240' into the connector shield 210'. A mount member 220' is also shown extending from the shield 210'.

Note that mount member 210', mounting feet 230, or a combination thereof can be used to attach the plug 200' to a printed circuit board 110 (FIG. 6A). This means that when mounting feet 230 are used, the conductor carrier 240' can function as a plug without the connector shield 210' being absolutely necessary, in that no mount member 220' is required. As well, the connector shield 210' can be included, but need not include mount member 220'. However, for increased durability and strength, a combination of mount member 220' and mounting feet 230 may be desirable, as shown in FIG. 3.

Figure 4:
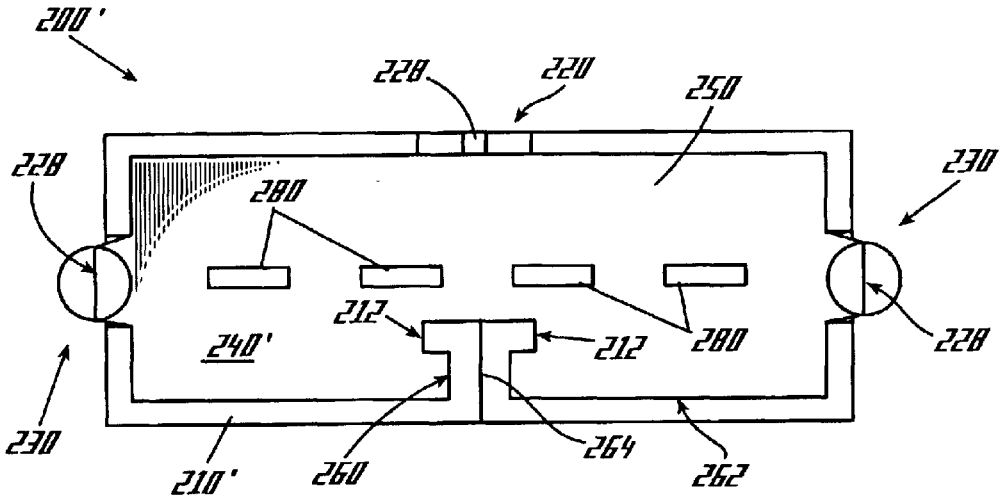
FIG. 4 is a rear view of the example electrical connector shown in FIG. 3, as assembled, in accordance with one embodiment of the invention.

FIGS. 3 and 4 also show an alternative embodiment to the seam 211 shown in FIG. 2D. The conductor carrier 240' includes a longitudinal groove 260 formed in its bottom surface 262. In the instant case, the longitudinal groove 260 is substantially T-shaped, but can be configured in other embodiments. Each opposing edge 212 of the connector shield 210' has received two substantially 90 degree bends such that when the opposing edges 212 are adjacent each other they form a substantially T-shaped ridge 264. To assemble the plug 200, the ridge 264 is placed in the groove 260 and the connector shield 210' is urged over the conductor carrier 240' until the retention tab 252 (FIG. 3) engages the retention orifice 207. Once assembled (FIG. 4), the groove 260 prevents the opposing edges 212 that form the ridge 264 from separating.

Certain instances may arise when it is advantageous to also mount a socket 502 of an electrical connector to a printed circuit board using mount members 520 (and/or mounting feet similar to feet 230) that extend parallel to a central longitudinal axis of the socket 502. FIG. 5 shows one preferred embodiment of a socket 502 arranged and configured to slidably receive a plug 200. Similar to the plug 200 shown in FIGS. 2A–2D, the socket 502 includes a conductor carrier 540 that supports and secures a plurality of conductors 570. Each of the plurality of conductors includes at least a contact portion 572 and a solder tail 580 to facilitate electrical contact with a printed circuit board. The connector shield 510 is disposed around the conductor carrier 540 as with the plug 200. However, as shown, the contact bed 542 does not directly abut the connector shield 510, leaving space between each surface of the contact bed 542 and each corresponding wall of the connector shield 210 at a front end 514. This is done in order to accommodate a plug 200 that includes a connector shield 210. Where the plug 200 does not include a shield, each surface of the contact bed 542 can abut the corresponding wall of the connector shield 510, with the exception of that surface actually supporting the contact portions 572.

Mount members 520 extend at least substantially parallel to a central longitudinal axis of the socket 502. Similarly, the solder tails 580 also extend at least substantially parallel to the central longitudinal axis, thereby permitting the socket 502 to be mounted with a rear end 515 of the shield 510 both parallel to and adjacent a surface of a printed circuit board. In other embodiments, the mount members 220 and 520 of both the plug 200 (FIGS. 2A–2D) and the socket 502, respectively, can also be configured to extend in a direction that is perpendicular to the central longitudinal axis. This latter configuration permits one or both of the socket 502 and the plug 200 to be mounted with their central longitudinal axis parallel to a printed circuit board.

Operation

FIGS. 6A and 6B show cross-sectional views of the plug 200 shown in FIGS. 2A–2D being mounted on a printed circuit board 110. First, the forward edges 226 of the enlarged head 224 are brought into contact with a corresponding mounting hole 116. Because the forward edges 226 are sloped, both sides of the mount member 220 are cammed toward each other as the mount member 220 is inserted into the mounting hole 116. Although not required in all embodiments, the longitudinal gap 228 permits this camming effect to take place. After the enlarged head 224 has passed through the mounting hole 116, both sides of the mount member 220 spring back into their initial positions, thereby securing the plug 200 in place, as shown in FIG. 6B.

Once the plug 200 is attached to the printed circuit board 110, both the mount members 220 and solder tails 280 extend beyond the backside 112 of the printed circuit board 110. This permits the solder tails 280 to be electrically connected to the printed circuit board 110 as well as the mount members 220 to be soldered in place to further secure the plug 200 to the top side 113 of the printed circuit board 110. While hand soldering is an option, ideally wave soldering is used on the solder tails 280 and mount members 220. This is possible because no cord and therefore no overmolding 15 (FIG. 1) is required to attach the plug 200 to the printed circuit board 110.

Figure 7A:
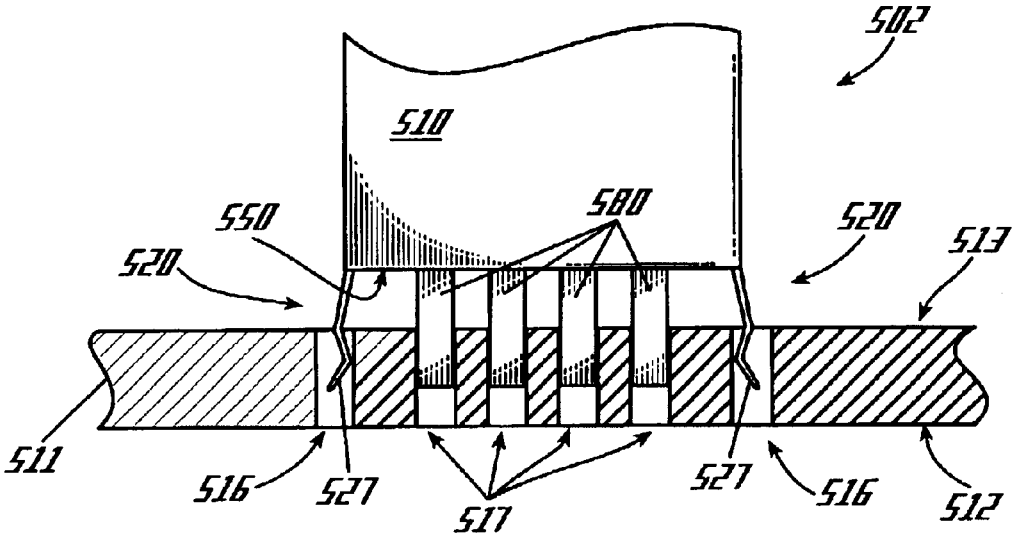
Figure 7B:
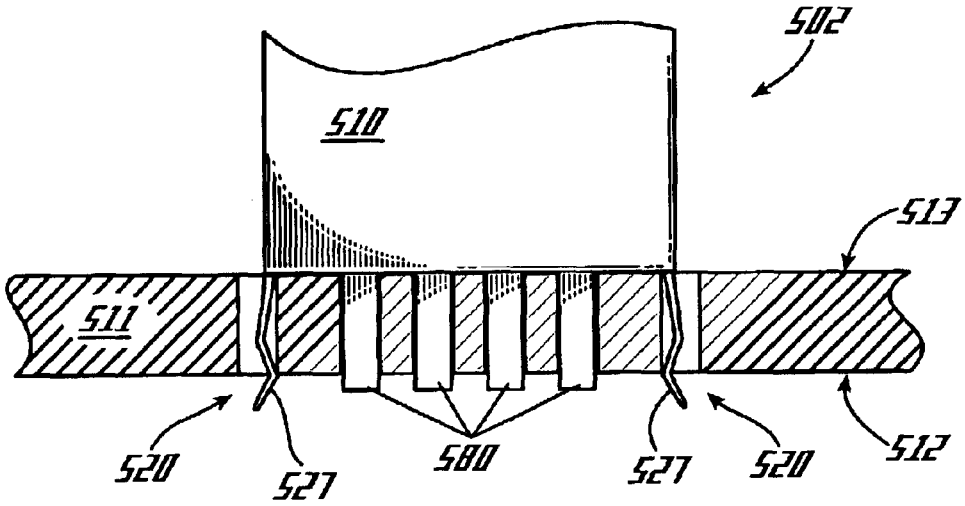

FIGS. 7A and 7B show cross-sectional views of the socket 502 shown in FIG. 5 being mounted on a printed circuit board 510. As shown in FIG. 7A, the camming surfaces 527 are first brought into contact with the corresponding mounting holes 516 in the printed circuit board 510. As the socket 502 is urged toward the printed circuit board 510, the interaction of the camming surfaces 527 with the mounting holes 516 urge the mount members 520 apart from each other. Also note, as the socket 502 is urged into abutment with the printed circuit board 510, the solder tails 580 are inserted through contact holes 517 in the printed circuit board 510. Ultimately, the rear surface 550 of the shield 510 contacts a topside 513 of the printed circuit board 510, at which point the mount members 520 securely hold the socket 502 in place by "gripping" the printed circuit board 510. In this position, both portions of the mount members 520 and solder tails 580 extend beyond a backside 512 of the printed circuit board 510 to facilitate soldering.

Embodiments of both the plug 200 and the socket 502 are envisioned wherein the mount members 220, 520 are electrically connected to a ground plane (not shown) in the associated printed circuit board, thereby grounding the electrical connector 200, 502.

Figure 8:
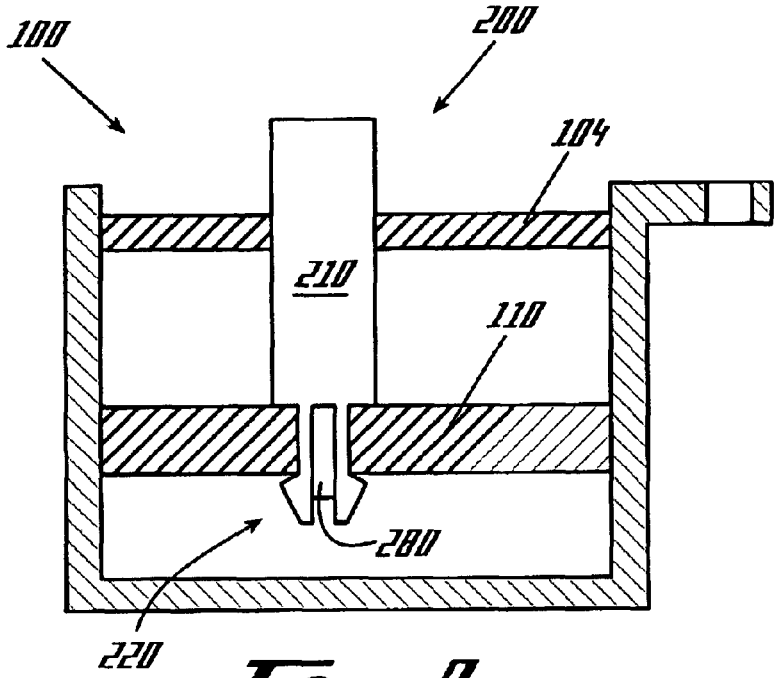
FIG. 8 is a cross-sectional view of a peripheral device including the example electrical connector as shown in FIGS. 2A–2D, mounted to a printed circuit board.

FIG. 8 shows a peripheral device 100 that includes the plug 200 as shown in FIGS. 2A–2D mounted to a printed circuit board 110. Because no cord 102 (FIG. 1) or overmolding is required for this configuration, the overall size of the peripheral device 100 can be minimized. In some embodiments, a backplane 104 can be used to lend further rigidity to the plug 200, which extends through a corresponding sized opening in the backplane 104. Because the plug 200 is securely mounted to the printed circuit board 110 rather than disposed at the end of a cord 502 (FIG. 1), the plug 200 can be readily blind-mated to the socket 502 (FIG. 5) of a host system. The peripheral device 100 can further be secured in place using a threaded fastener (not shown) or similar fastening mechanism to connect the peripheral device 100 to the host system.

Figure 9:
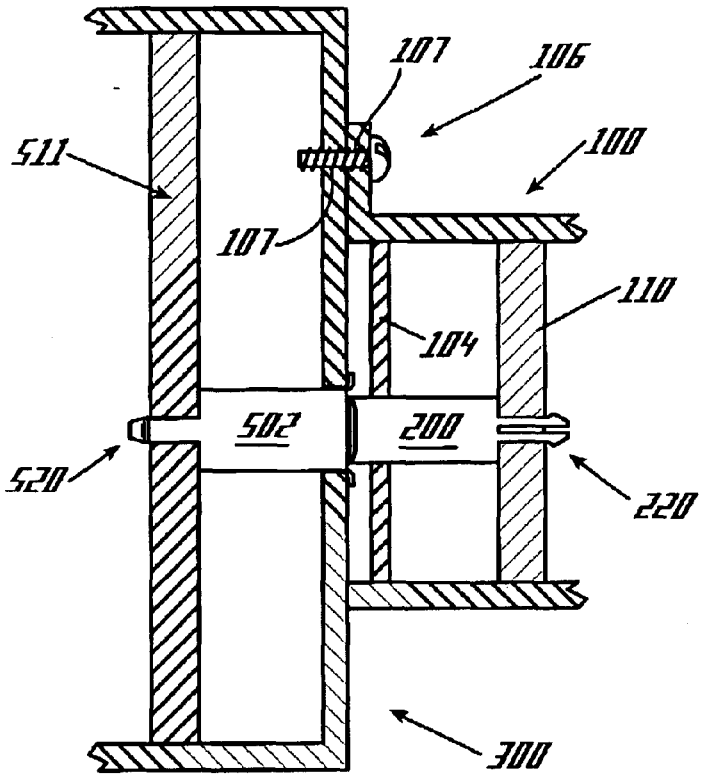
FIG. 9 is a cross-sectional view of a peripheral device including the example electrical connector of FIGS. 2A–2D, mounted to a host system including the example electrical connector of FIG. 5.

FIG. 9 shows a peripheral device 100 incorporating a plug 200 constructed in accordance with the present invention attached to a host system 300. The socket 502 of the host system 300 is also constructed in accordance with one embodiment of the present invention. Note, the plug 200 and socket 502 are attached to associated printed circuit boards 110, 510 by their associated mount members 220 and 520, respectively. Also, although not necessary, a threaded fastener 106 passing through matching holes 107 in the peripheral device 100 and host system 300 is used to secure the peripheral device 100 in place.

Figure 10:
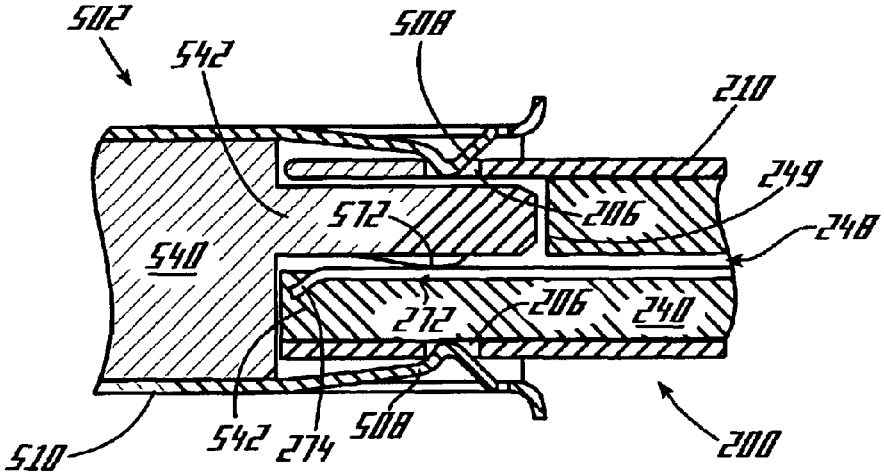
FIG. 10 is a cross-sectional view of the example electrical connectors shown in FIG. 9.

FIG. 10 shows a cross-sectional view of the plug 200 and socket 502 (FIG. 9) in a fully engaged position. In this position, the contact portions 272, 572 of the plug 200 and socket 502, respectively, make electrical contact with each other. To help ensure the front end of plug 200 and front end of socket 502 remain fully engaged, the securing fingers 508 of the socket 502 engage corresponding securing recesses 206 on the plug 200.

Although various shapes and sizes are envisioned for various embodiments of the electrical connectors of the present invention, including the exchanging of various mounting members and feet, among others, the preferred embodiments are dimensioned and utilize materials that are in accordance with the Universal Serial Bus Specifications, which are herein fully incorporated by reference.

It should be emphasized that the above-described embodiments of the present electrical connector, particularly, any "preferred" embodiments, are merely possible examples of implementations, merely set forth for a clear understanding of the principles of the electrical connector. Many variations and modifications may be made to the above-described embodiment(s) of the electrical connector without departing substantially from the spirit and principles of the electrical connector. All such modifications and variations are intended to be included herein within the scope of this disclosure and the electrical connector and protected by the following claims.

Therefore, at least the following is claimed:

1. A plug comprising:

a conductor carrier having a nose, a body portion, a rear surface, a contact bed, and at least one mounting foot, wherein the at least one mounting foot extends beyond the rear surface and at least substantially parallel to a longitudinal axis between the nose and the rear surface, the at least one mounting foot being configured to extend through and engage a matching mounting hole in a printed circuit board;

at least one conductor, wherein each of the at least one conductors includes a solder tail, a central portion, and a contact portion, and each of the at least one conductors is positioned such that the contact portion is supported by the contact bed, the central portion is embedded in the body portion, and the solder tail extends beyond and perpendicular to the rear surface for insertion into the printed circuit board, and wherein the central portion further comprises at least one serrated edge;

a connector shield enclosing at least a portion of the at least one conductor; and a mount member for connecting the plug to the printed circuit board.

2. The plug of claim 1, wherein the at least one mounting foot is disposed on the rear surface.

3. The plug of claim 1, wherein the at least one mounting foot is disposed on a side surface of the conductor carrier.

4. The plug of claim 1, wherein the connector shield further includes a front end and a back end, and the mount member is connected to the back end of the shield.

5. The plug of claim 4, wherein the at least one mount member extends at least substantially parallel to a longitudinal axis between the front end and the back end.

6. The plug of claim 4, wherein the connector shield is adapted for rigid attachment to the printed circuit board.

7. The plug of claim 6, wherein the front end is adapted to connect to a socket.

8. The plug of claim 1, further comprising:

a conductor carrier; and wherein the conductor carrier is enclosed, at least partially, by the connector shield.

9. The plug of claim 8, wherein the plug is enclosed in a peripheral device.

10. The plug of claim 9, wherein the peripheral device is a stationary device adapted for rigid attachment to a host system.

11. The plug of claim 1, wherein the connector shield is disposed about the conductor carrier, the at least one mount member extends beyond the rear surface and is configured to extend through and engage a matching mounting hole in the printed circuit board.

12. The plug of claim 11, wherein the shield is constructed from sheet metal.

13. An electrical system, comprising:

a conductor carrier having a central longitudinal axis, a body portion, a contact bed, a bottom surface, and a rear surface, wherein the conductor carrier having a groove disposed in the bottom surface, the groove running at least substantially parallel to the central longitudinal axis, and wherein the groove and the ridge are T-shaped;

at least one conductor, each of the at least one conductors including a solder tail, a central portion, and a contact portion; and a connector shield including a front end, a back end, and at least one mount member being arranged and configured to attach the connector shield to a printed circuit board, the connector shield being disposed around the conductor carrier, the at least one mount member extending at least substantially parallel to the central longitudinal axis and exiting beyond the rear surface, wherein the conductor shield is constructed of sheet metal having a pair of opposed edges, the pair of opposed edges forming a ridge, wherein the ridge is received in the groove, thereby securing the connector shield to the conductor carrier, wherein each of the at least one conductors is disposed in the conductor carrier at least substantially parallel to the central longitudinal axis, the central portion is embedded in the body portion, the contact portion is supported by the contact bed, and the solder tail extends beyond the rear surface.

14. The electrical system of claim 13, further comprising:

a printed circuit board including at least one mounting hole; and wherein each of the at least one mount members is inserted into a corresponding one of the at least one mounting holes.

15. The electrical system of claim 14, the printed circuit board further includes at least one contact bole and each of the solder tails is inserted into one of the at least one contact holes.

16. The electrical system of claim 15, wherein the at least one mount member and the at least one solder tail is soldered to the printed circuit board.

17. A plug configured for rigid attachment to a printed circuit board, comprising:

a conductor carrier having a nose, a body portion, a rear surface, a contact bed, and a central longitudinal axis between the nose and the rear surface;

a plurality of conductors, each of the conductors having a solder tail, a central portion, and a contact portion, each of the conductors being disposed at least substantially parallel to the central longitudinal axis such that that contact portion is supported by the contact bed, the central portion is embedded in the body portion, and the solder tail extends beyond the rear surface for insertion into the printed circuit board;

a connector shield disposed around the conductor carrier and having a front end, a back end, a first edge and a second edge, the first edge having a pair of interlocking tabs, the second edge having a pair of interlocking recesses, the interlocking tabs and recesses being configured to hold the connector about the conductor carrier, and a pair of mount members disposed on the back end and extending at least substantially parallel to the central longitudinal axis, each of the mount members having a stem portion, an enlarged head, and a longitudinal gap, each of the stem portions having a first end and a second end, the first end being contiguous to the back end, the enlarged head being disposed on the second end, and the longitudinal gap extending from the first end to the enlarged head, the longitudinal gap dividing the mounting member into a pair of substantially identical halves; and wherein each of the enlarged heads engages the printed circuit board after having been urged through a pair of corresponding mounting holes formed therein.

18. A plug configured for rigid attachment to a printed circuit board, comprising:

a conductor carrier having a nose, a body portion, a rear surface, a contact bed, at least one side surface, at least one mounting foot, and a central longitudinal axis between the nose and the rear surface, the at least one mounting foot being disposed on the at least one side surface and extending beyond the rear surface at least substantially parallel to the central longitudinal axis, the at least one mounting foot being configured to engage a matching mounting hole in the printed circuit board;

a plurality of conductors, each of the conductors having a solder tail, a central portion, and a contact portion, each of the conductors being disposed at least substantially parallel to the central longitudinal axis such that that contact portion is supported by the contact bed, the central portion is embedded in the body portion, and the solder tail extends beyond the rear surface for insertion into the printed circuit board;

a connector shield disposed around the conductor carrier and having a front end, a back end, a first edge and a second edge, the first edge having a pair of interlocking tabs, the second edge having a pair of interlocking recesses, the interlocking tabs and recesses being configured to hold the connector about the conductor carrier, a pair of mount members disposed on the back end and extending at least substantially parallel to the central longitudinal axis, each of the mount members having a stem portion, an enlarged head, and a longitudinal gap, each of the stem portions having a first end and a second end, the first end being contiguous to the back end, the enlarged head being disposed on the second end, and the longitudinal gap extending from the first end to the enlarged head, the longitudinal gap dividing the mounting member into a pair of substantially identical halves, and at least one recess, each of the at least one recesses being configured to slidably receive one of the at least one mounting feet; and wherein each of the enlarged heads engages the printed circuit board after having been urged through a pair of corresponding mounting holes formed therein.

* * * * *